US008156776B2

(12) United States Patent
Seki

(10) Patent No.: US 8,156,776 B2
(45) Date of Patent: Apr. 17, 2012

(54) CARD TYPE MECHANICAL KEY

(75) Inventor: Yoshiyuki Seki, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 239 days.

(21) Appl. No.: 12/472,912

(22) Filed: May 27, 2009

(65) Prior Publication Data

US 2009/0293565 A1 Dec. 3, 2009

(30) Foreign Application Priority Data

May 29, 2008 (JP) ..... 2008-140689

(51) Int. Cl.
*E05B 19/00* (2006.01)

(52) U.S. Cl. ..... 70/395; 340/5.2

(58) Field of Classification Search ..... 70/352, 70/385, 387, 393, 402, 405, 406, 408, 409, 70/413, 456 R, 395; 340/5.2, 5.65
See application file for complete search history.

(56) References Cited

U.S. PATENT DOCUMENTS

| | | | | | |
|---|---|---|---|---|---|
| 1,657,391 | A * | 1/1928 | Haney | 510/439 |
| 3,344,629 | A * | 10/1967 | Burney | 70/282 |
| 3,672,191 | A * | 6/1972 | Regan | 70/393 |
| 3,802,101 | A * | 4/1974 | Scantlin | 283/87 |
| 3,906,447 | A * | 9/1975 | Crafton | 235/382.5 |
| 3,927,543 | A * | 12/1975 | Anastasov | 70/395 |
| 4,119,361 | A * | 10/1978 | Greenaway | 283/88 |
| 4,452,059 | A * | 6/1984 | Sornes | 70/278.2 |
| 4,544,184 | A * | 10/1985 | Freund et al. | 283/94 |
| 4,583,766 | A * | 4/1986 | Wessel | 283/88 |
| 4,637,236 | A * | 1/1987 | Almblad | 70/458 |
| 4,694,148 | A * | 9/1987 | Diekemper et al. | 235/468 |
| 4,941,686 | A * | 7/1990 | Johnson | 283/87 |
| 5,181,407 | A * | 1/1993 | Wu | 70/361 |
| 5,355,701 | A * | 10/1994 | Tobias | 70/394 |
| 5,620,090 | A * | 4/1997 | Beeley | 206/234 |
| 6,875,105 | B1 * | 4/2005 | Behm et al. | 463/17 |
| 7,055,273 | B2 * | 6/2006 | Roshkoff | 40/638 |
| 7,422,146 | B2 * | 9/2008 | Dennett | 235/380 |
| 2009/0212903 | A1 * | 8/2009 | Tamezane et al. | 340/5.2 |

FOREIGN PATENT DOCUMENTS

| | | |
|---|---|---|
| JP | 3090369 | 9/2002 |
| JP | 2007-142886 | 6/2007 |

* cited by examiner

*Primary Examiner* — Suzanne Barrett
(74) *Attorney, Agent, or Firm* — Patterson Thuente Christensen Pedersen P.A.

(57) ABSTRACT

A card type mechanical key including a card member having a card surface and an edge portion. The card member includes a mechanical code pattern formed by partially eliminating the card surface or the edge portion and functioning as a verification code mechanically verifiable by a lock device. A fitting member is fitted to the mechanical code pattern. A concealment sticker is adhered removably to the card member in a state in which the fitting member is fitted to the mechanical code pattern of the card member so as to conceal the mechanical code pattern and the fitting member.

6 Claims, 4 Drawing Sheets

CARD TYPE MECHANICAL KEY

CROSS-REFERENCE TO RELATED APPLICATIONS

This application is based upon and claims the benefit of priority from prior Japanese Patent Application No. 2008-140689, filed on May 29, 2008, the entire contents of which are incorporated herein by reference.

BACKGROUND ART

The present invention relates to a card type mechanical key including a mechanical key verification code formed by a mechanical code pattern, and more particularly, to a measure for preventing tampering with a mechanical verification code.

Japanese Utility Model Registration No. 3090369 describes an example of a card type mechanical key. The card type mechanical key includes a plurality of holes laid out in a pattern so as to function as a mechanical verification code. Further, the card type mechanical key fits into a wallet or a card case in the same manner as a credit card or a driver's license. Japanese Laid-Open Patent Publication No. 2007-142886 describes an electronic key powered by a battery to perform locking and unlocking through wireless communication. The electronic key includes a card type mechanical key that functions as a locking and unlocking means when an anomaly occurs, such as when the battery voltage becomes low, and wireless communication becomes difficult. A card type electronic key that improves portability has also been proposed.

SUMMARY OF THE INVENTION

With a card type mechanical key such as that described in the '369 publication, the mechanical code pattern may be wrongfully duplicated and used due to improvements that have been seen over recent years in duplication techniques. Accordingly, the inventor in the present application has studied techniques for preventing wrongful duplication of a mechanical verification code for a card type mechanical key, that is, wrongful duplication of the portion of a card type mechanical key in which a plurality of holes are formed.

The applicant has found a shortcoming in a card type mechanical key 101 that will now be described with reference to FIGS. 9 and 10. The card type mechanical key 101 has a surface including a mechanical code pattern formed by a plurality of holes **130*h*. The holes 130*h* are concealed by two sheets of concealment stickers 117 and 118. However, the portions of the concealment stickers 117 and 118 that correspond to the holes 130*h* deform inwardly into the holes 130*h* and form depressions 120 in the concealment stickers 117 and 118. The layout pattern of the holes 130*h* that defines a verification code is thus discernible. To reduce the thickness of the card type mechanical key, concealment stickers are apt to be formed with a minimized thickness. However, the depressions 120 form more easily as the concealment stickers 117 and 118** become thinner. In this manner, the inventor of the present invention has found that the verification code of a card type mechanical key cannot be sufficiently concealed by the adherence of concealment stickers.

The present invention provides a card type mechanical key that improves the level of security by preventing duplication of a mechanical code pattern that functions as a mechanical verification code in a card type mechanical key.

One aspect of the present invention is a card type mechanical key including a card member having a card surface and an edge portion. The card member includes a mechanical code pattern functioning as a verification code mechanically verifiable by a lock device. The mechanical code pattern is formed by partially eliminating the card surface or the edge portion. A fitting member is fitted to the mechanical code pattern. A concealment sticker is adhered removably to the card member in a state in which the fitting member is fitted to the mechanical code pattern of the card member so as to conceal the mechanical code pattern and the fitting member.

In this structure, the fitting member fitted into the mechanical code pattern of the card member flattens the card surface and edge portion. In this state, the concealment sticker is adhered to the card member. Thus, the concealment sticker does not deform inwardly at portions corresponding to the mechanical code pattern and depressions do not form in the concealment sticker. As a result, such depressions cannot be used to discern the mechanical code pattern. Accordingly, this structure contributes to preventing duplication of the mechanical code pattern.

In the above aspect, the concealment sticker includes an adhesive surface to which an adhesive agent is applied. The adhesive surface is adhered to the card member. The fitting member is retained on the concealment sticker by the adhesive agent of the concealment sticker. When removing the concealment sticker from the card member, the fitting member is separated from the mechanical code pattern together with the concealment sticker in a state adhered to the adhesive surface of the concealment sticker.

In this structure, after removal of the concealment sticker, the fitting member does not have to be separated from the mechanical code pattern. This enables use of the card type mechanical key as soon as the concealment sticker is removed and is thereby convenient for the user.

In the above aspect, a brittle member partially connects the mechanical code pattern of the card member and the fitting member. The brittle member, the fitting member, and the card member are formed integrally. The brittle member breaks when subjected to an external force separating the fitting member from the mechanical code pattern during use of the mechanical key.

In this structure, the concealment sticker may be adhered to the card member without having to perform the burdensome task of fitting the fitting member to the card member after forming the mechanical code patter in the card pattern. Further, the brittle member connects the fitting member to the portion of the card member in which the mechanical code pattern is formed. This prevents unexpected removal of the fitting member when, for example, adhering the concealment sticker to the card member.

The mechanical strength of the brittle member may be set to a level in which the brittle member breaks during removal of the concealment sticker from the card member. When removing the concealment sticker, external force, which is in accordance with the fastening force of the fitting member to the adhesive surface of the concealment sticker, is applied to the fitting member. This breaks the brittle member and separates the fitting member from the card type mechanical key. The separated fitting member is removed in a state adhered to the adhesive surface of the concealment sticker.

In the above aspect, a communication circuit performs electronic verification through wireless communication with a controller that electrically opens and closes the lock device.

In this structure, mechanical verification and electronic verification are performed with the same card type mechanical key. This is convenient since a user may perform locking and unlocking as long as the user is carrying the card type mechanical key even during an emergency in which either one of mechanical verification and electronic verification becomes unusable.

In the above aspect, the fitting member has an end surface that is flush with the card surface when fitted to the mechanical code pattern.

In this structure, no depressions are formed in the concealment sticker at portions corresponding to the mechanical code pattern.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
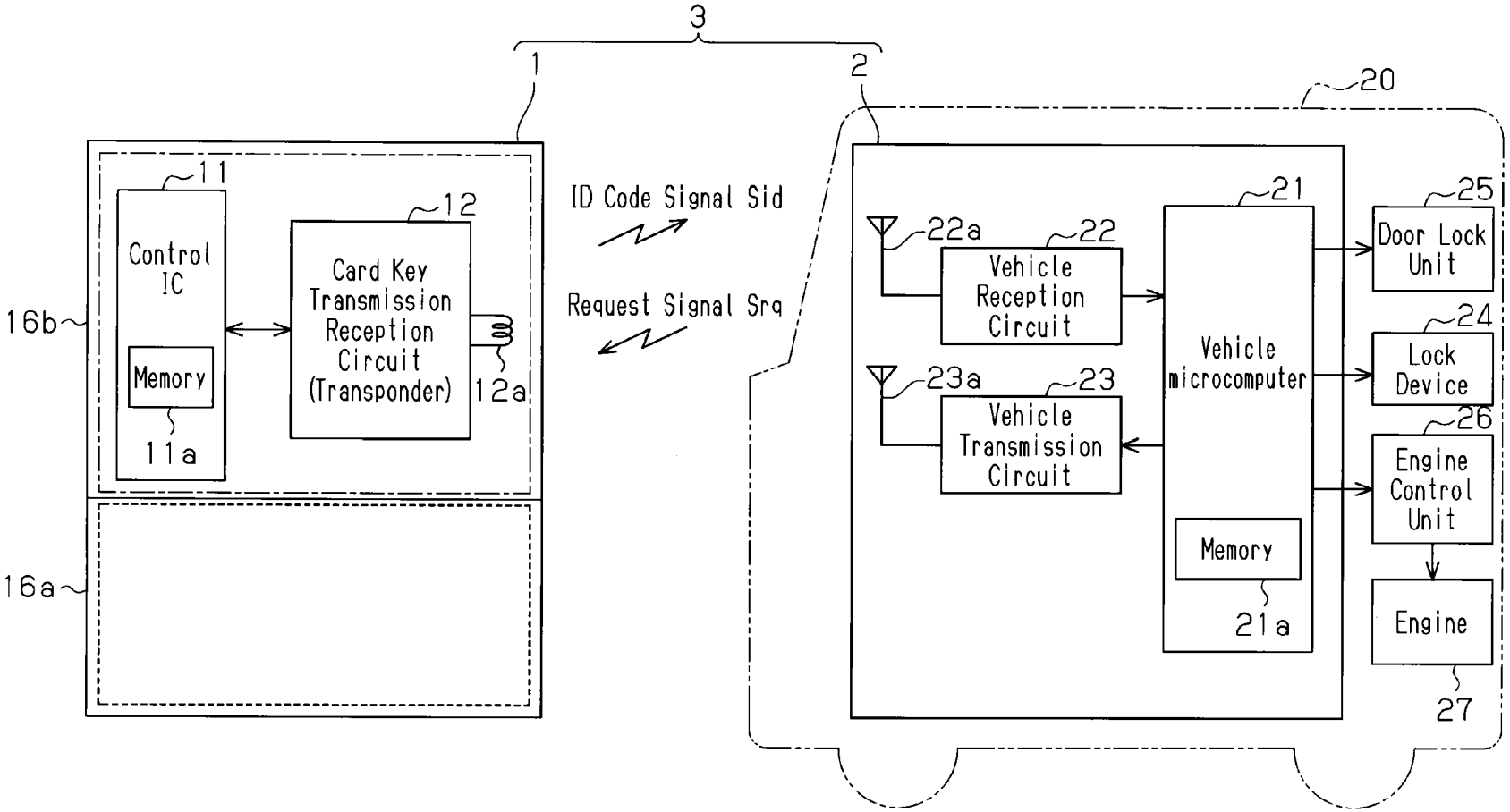
FIG. 1 is a block diagram showing the electrical structure of an electronic key system according to a first embodiment of the present invention.

A card key 1 according to a first embodiment of the present invention will now be discussed with reference to the drawings. The card key 1 is for use with an electronic key system 3 for a vehicle (e.g., a four-wheel vehicle, a two-wheel vehicle, and other types of vehicles). In the electronic key system 3, wireless communication is performed between the card key 1, which is held by a user of a vehicle 20, and a communication controller 2, which is installed in the vehicle 20. Under the condition that wireless communication is established between the card key 1 and the communication controller 2, the electronic key system 3 permits the locking and unlocking of doors and enables the engine to be started.

The communication controller 2 transmits a request signal Srq (radio wave) to a predetermined transmission area formed outside the vehicle and in the passenger compartment via a vehicle transmission circuit 23 and an antenna 23*a*, which is connected to the vehicle transmission circuit 23. In one example, the request signal Srq is transmitted through wireless communication in an intermittent manner.

When the card key 1 is present in the transmission area, the card key 1 receives the request signal Srq via a loop antenna 12*a* and a card key transmission-reception circuit 12. In response to the received request signal Srq, the card key 1 transmits an ID code signal Sid (radio wave), which includes an ID code stored in a memory 11*a* of a control IC arranged in the card key 1, to the communication controller 2 via the transmission-reception circuit 12 and loop antenna 12*a*. In this embodiment, the control IC 11 and the card key transmission-reception circuit 12 (including the loop antenna 12*a*) form a communication circuit 13.

When receiving the ID code signal Sid from the card key 1 via an antenna 22*a* and a vehicle reception circuit 22, the communication controller 2 compares an ID code, which is stored in a memory 21*a* of a vehicle microcomputer 21 arranged in the communication controller 2, with the ID code included in the received ID code signal Sid. When the ID codes correspond to each other, the communication controller 2 determines that ID verification has been established through wireless communication between the communication controller 2 and the card key 1. In such a case, the communication controller 2 permits a door lock unit 25 of the vehicle 20 to lock and unlock doors and enables an engine control unit 26 to start the engine 27. In this manner, when the ID code transmitted from the card key 1 is authentic, the door lock unit 25 and engine control unit 26, which serve as in-vehicle devices arranged in the vehicle 20, are permitted to execute control.

The card key transmission-reception circuit 12 shown in FIG. 1 includes the functions of a transponder (transmission-reception circuit capable of storing power transmitted through electromagnetic coupling) and is supplied with drive power in a non-contact manner through electromagnetic coupling with a transponder power transmission circuit (not shown) arranged in the vehicle 20.

In this embodiment, when an anomaly occurs such as when the battery of the card key 1 is drained or when the battery of the vehicle 20 (vehicle power source) is drained, the card key 1 does not function normally. For example, depending on the decrease in the voltage of the battery, which is retained in the card key 1, or the battery, which supplies operational power to each part of the vehicle 20, normal wireless communication between the card key 1 and vehicle 20 may become difficult. To prepare for such an anomaly, the card key 1 employs a structure that will now be discussed.

Figure 2:
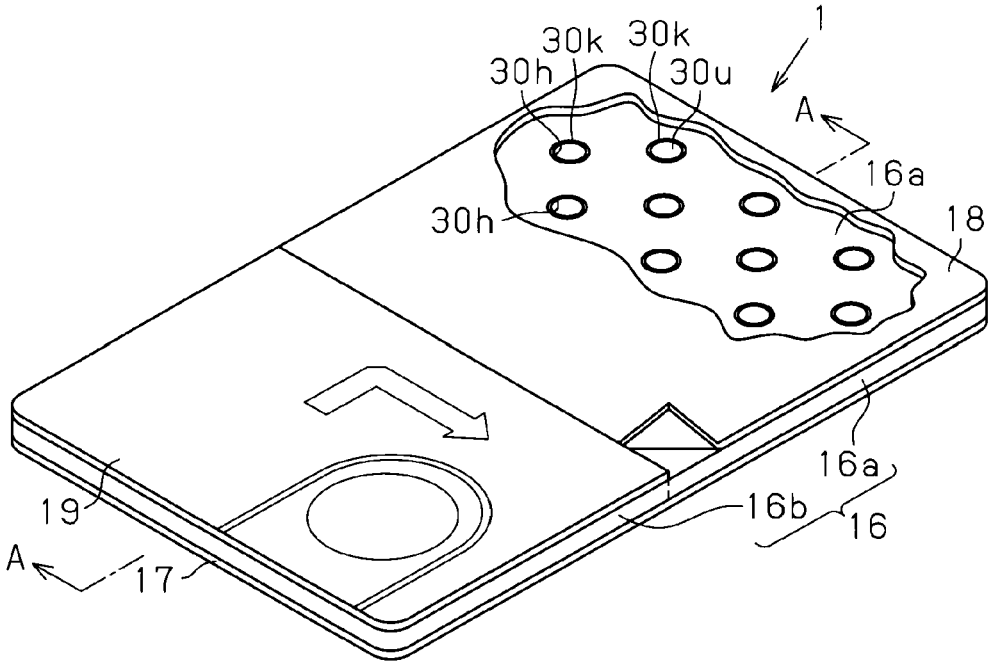
FIG. 2 is a perspective view showing a card key of the first embodiment.

Referring to FIG. 2, the card key 1 includes a card member, or main card body 16, which may be flat, rectangular, flexible, and card-shaped. The main card body 16 may be formed from, for example, a non-conductive resin material. One example of such a material is polypropylene resin. The main card body 16 has two portions, namely, a first card portion 16*a* and a second card portion 16*b*. The border of the two portions 16*a* and 16*b* is located near the longitudinally middle part of the main card body 16.

The communication circuit 13 (shown in FIG. 1) may be accommodated in the second card portion 16*b*. The second card portion 16*b* functions as a so-called electronic key that locks and unlocks doors through wireless communication with the vehicle 20. The main card body 16 is formed by a non-conductive material and thus does not impede wireless communication performed by the communication circuit 13. The loop antennal 12*a* of the communication circuit 13 may be a pattern antenna printed onto the surface of the second card portion 16*b*.

The first card portion 16*a* functions as a mechanical key that performs mechanical ID verification when inserted into a lock device 24 arranged in, for example, a door of the vehicle and for permitting mechanical opening and closing of the lock device 24 when ID verification is established. As described above, when an anomaly occurs, for example, when the battery voltage of the card key 1 decreases such that normal wireless communication cannot be performed between the card key 1 and the vehicle 20, the first card portion 16*a* serving as the mechanical key is used to open and close the lock device 24.

Referring to FIG. 2, the first card portion 16*a* includes a plurality of through holes 30*h* extending orthogonally to the planar direction of the first card portion 16*a*. The through holes 30*h* are laid out in a pattern that functions as a mechanical verification code used with the lock device 24. Each of the through holes 30*h* may be a round hole having a round opening. To form the round through holes 30*h*, a laser beam may be emitted against a blank first card portion 16*a* in a direction orthogonal to the plane of the first card portion 16*a*. Alternatively, the first card portion 16*a* may be machined to form the through holes 30*h*.

Each through hole 30*h*, which is formed by eliminating part of the first card portion 16*a* as described above, receives a plug or a fitting member 30*u*, which is shaped in correspondence with the through hole 30*h*. In one embodiment, the fitting member 30*u* may be cylindrical. The fitting member 30*u*, which has such a mating relationship with the through hole 30*h*, is formed to have an axial length that is substantially the same as the thickness of the first card portion 16*a*. Thus, when fitted into the through hole 30*h*, the two opposite axial end surfaces of the fitting member 30*u* are flush with the front and rear surfaces of the first card portion 16*a*.

The fitting member 30*u* may be formed so that when fitted into the through hole 30*h*, the two opposite axial end surfaces of the fitting member 30*u* are located slightly inward from the front and rear surfaces of the first card portion 16*a*. It is only required that when the fitting members 30*u* are fitted to the through holes 30*h*, the front and rear surfaces of the main card body 16, more precisely, the first card portion 16*a*, are substantially flat and substantially free from projection and recesses. Further, cylindrical parts cut out from the first card portion 16*a* to form the through holes 30*h* may be used as the fitting members 30*u*. In this case, the fitting members 30*u* and the main card body 16 may be formed from same material, such as a non-conductive resin material. Alternatively, discrete members prepared beforehand may be used as the fitting members 30*u*.

A structure described below is employed in this embodiment to conceal the through holes 30*h* and fitting members 30*u*.

Figure 4:
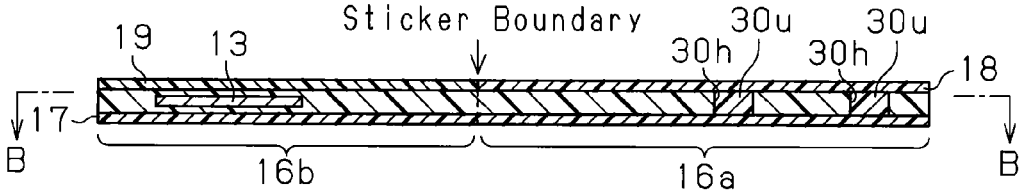
FIG. 4 is a cross-sectional view taken along line A-A in FIG. 2.

Referring to FIG. 4, a first concealment sticker 18 is adhered in a removable manner to the front surface, or outer surface, of the main card body 16 in which the layout pattern of the through holes 30*h* including the fitting members 30*u* is formed. The first concealment sticker 18 conceals the through holes 30*h* and the fitting members 30*u*. A covering sticker 19 is adhered to the front surface of the second card portion 16*b*, which includes the communication circuit 13, to cover the front surface. An adhesive agent is applied to the rear surface of the covering sticker 19. When the loop antenna 12*a* is arranged on the front surface of the second card portion 16*b*, the covering sticker 19 covers and protects the loop antenna 12*a*.

The first concealment sticker 18 and the covering sticker 19 are formed, for example, from a non-conductive polyester resin material as a flat film having a planar shape that is substantially identical to the planar shapes of the first card portion 16*a* and second card portion 16*b*, respectively. The first concealment sticker 18 and covering sticker 19 have substantially the same thickness. The thickness is set so as not to adversely affect the flexibility of the main card body 16. Further, the first concealment sticker 18 and the covering sticker 19 are opaque.

The opaque first concealment sticker 18 covers every one of the through holes 30*h* and the fitting members 30*u* from the front surface of the first card portion 16*a*. This conceals the layout pattern of the through holes 30*h*, which serves as the verification code, at the front surface of the main card body 16. Further, the first concealment sticker 18 protects the front surface of the first card portion 16*a*, namely, the layout pattern of the through holes 30*h*. Additionally, as described above, the first concealment sticker 18 and the covering sticker 19 are formed from a non-conductive material and therefore do not impede wireless communication of the communication circuit 13. The first concealment sticker 18 may be formed from any other non-conductive material.

A second concealment sticker 17 is adhered to the entire main card body 16, namely, the rear surfaces of the first card portion 16*a* and second card portion 16*b*. The second concealment sticker 17 has a planar shape that is substantially identical to the planar shape of the main card body 16. The second concealment sticker 17 entirely has a substantially uniform thickness. The thickness is set so as not to adversely affect the flexibility of the main card body 16. In the same manner as the first concealment sticker 18, the second concealment sticker 17 is formed from a non-conductive polyester resin material and is opaque.

Accordingly, the second concealment sticker 17 covers every one of the through holes 30*h* and the fitting members 30*u* from the rear surface of the first card portion 16*a*. This conceals the layout pattern of the through holes 30*h*, which serves as the verification code, at the rear surface of the main card body 16. Further, the second concealment sticker 17 protects the rear surface of the first card portion 16*a*.

An adhesive agent is applied to the rear surfaces of the first concealment sticker 18 and the covering sticker 19. The adhesive agent may be acrylic adhesive or an solvent type acrylic adhesive. The first concealment sticker 18 and covering sticker 19 are adhered by the adhesive agent in a removable manner to the main card body 16, namely, the front surfaces of the first card portion 16*a* and second card portion 16*b*. For security reasons, it is preferable that the adhesive agent of the first concealment sticker 18 have an adhesiveness that ensures adhesion of the first concealment sticker 18 to the first card portion 16*a* but does not allow adhesion of the first concealment sticker 18 once it is removed from the first card portion 16*a*. A concealment sticker having such low adhesiveness allows the user to easily and quickly check whether a third party has tampered with the concealment sticker. Further, the adhesiveness of the adhesive agent applied to the rear surface of the first concealment sticker 18 and the adhesiveness of the adhesive agent applied to the second concealment sticker 17 are set so that the first concealment sticker 18 may be removed from the main card body 16 with the fitting members 30*u* fastened to the rear surface of the first concealment sticker 18. For example, the adhesiveness of the adhesive agent applied to the first concealment sticker 18 is greater than that of the adhesive agent applied to the second concealment sticker 17. The covering sticker 19 only needs to protect the communication circuit 13. Thus, an adhesive agent that disables removal of the covering sticker 19 once it is adhered may be used.

As described above, the fitting members 30*u* are fitted to the through holes 30*h* so that the main card body 16, namely, the front and rear surfaces of the first card portion 16*a* are both flat and free from projections and recesses. In this state, the first concealment sticker 18 and second concealment sticker 17 are respectively adhered to the front and rear surfaces of the first card portion 16*a*. Thus, unlike the structure shown in FIGS. 9 and 10 that does not include the fitting members 30*u*, portions of the first concealment sticker 18 and second concealment sticker 17 corresponding to the through holes 30*h* do not deform inwardly. Thus, depressions do not form in the first concealment sticker 18 and second concealment sticker 17. Consequently, the layout pattern of the through holes 30*h* functioning as the verification code cannot be discerned from such depressions.

The card key 1 is formed so that it is compact and fits into a wallet or a card case. Thus, it is preferable that the first concealment sticker 18, the second concealment sticker 17, and the covering sticker 19 have a minimized thickness. Although the first concealment sticker 18 and second concealment sticker 17 deform more easily as they become thinner, the fitting members 30*u* fitted to the through holes 30*h* restrict inward deformation of the first concealment sticker 18 and second concealment sticker 17 into the through holes 30*h*. Thus, the through holes 30*h* functioning as the verification code are sufficiently concealed even when reducing the thickness of the first concealment sticker 18 and second concealment sticker 17.

Figure 5:
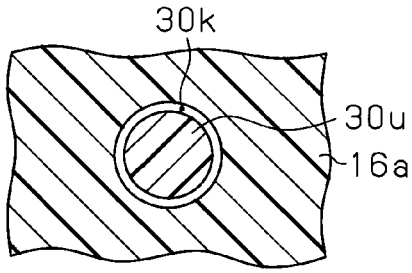
FIG. 5 is a cross-sectional view taken along line B-B in FIG. 4.

Particularly, when reducing the thickness of the first concealment sticker 18 and the second concealment sticker 17, the shortcoming described next may occur. As shown in FIG. 5, the first card portion 16*a* and each fitting member 30*u* are discrete unconnected components. This forms a small annular gap, or clearance 30*k*, between the wall surface defining each through hole 30*h* of the first card portion 16*a* and the peripheral surface of the corresponding fitting member 30*u*. Thus, when excessively reducing the thickness of the first concealment sticker 18 and second concealment sticker 17, sticker portions corresponding to the clearances 30*k* may deform inwardly into the clearances 30*k* and form depressions. Thus, to further improve the effect for concealing the through holes 30*h*, the thickness of the first concealment sticker 18 and second concealment sticker 17 should be set so that they do not deform when the clearances 30*k* form slight steps in the front and rear surfaces of the main card body 16.

Figure 3:
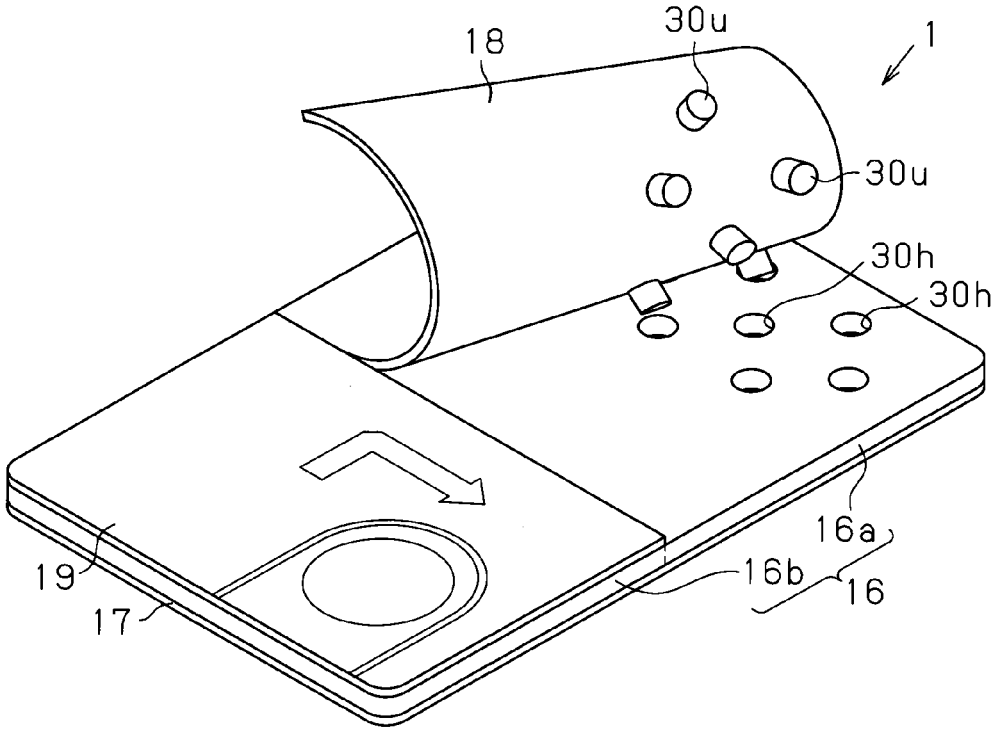
FIG. 3 is a perspective view showing the card key in a state in which a concealment sticker is being removed.

The usage of the card key 1 will now be discussed. In a normal state, the card key 1 locks and unlocks the doors through wireless communication. However, when an anomaly occurs, such as when the battery of the card key 1 or vehicle 20 is drained, the locking and unlocking of the doors through wireless communication becomes difficult. In such a case, the locking and unlocking of a door is permitted in the following manner. As shown in FIG. 3, the first concealment sticker 18 is removed from the first card portion 16*a*. When removing the first concealment sticker 18, the fitting members 30*u* are separated from the through holes 30*h* in a state adhered to the adhesive surface of the first concealment sticker 18 due to the adhesiveness of the adhesive agent applied to the adhesive surface. After the removal of the first concealment sticker 18, the fitting members 30*u* are held in a state fastened to the adhesive surface of the first concealment sticker 18. The removal of the first concealment sticker 18 separates the fitting members 30*u* from the through holes 30*h* and exposes the through holes 30*h*. As a result, the first card portion 16*a* becomes usable as a mechanical key. In this state, by inserting the first card portion 16*a*, which serves as the mechanical key, into the lock device 24, mechanical ID verification is performed with the vehicle 20. When ID verification is established, the opening and closing of the lock device 24 is permitted.

The first embodiment has the advantages described below.

Figure 9:
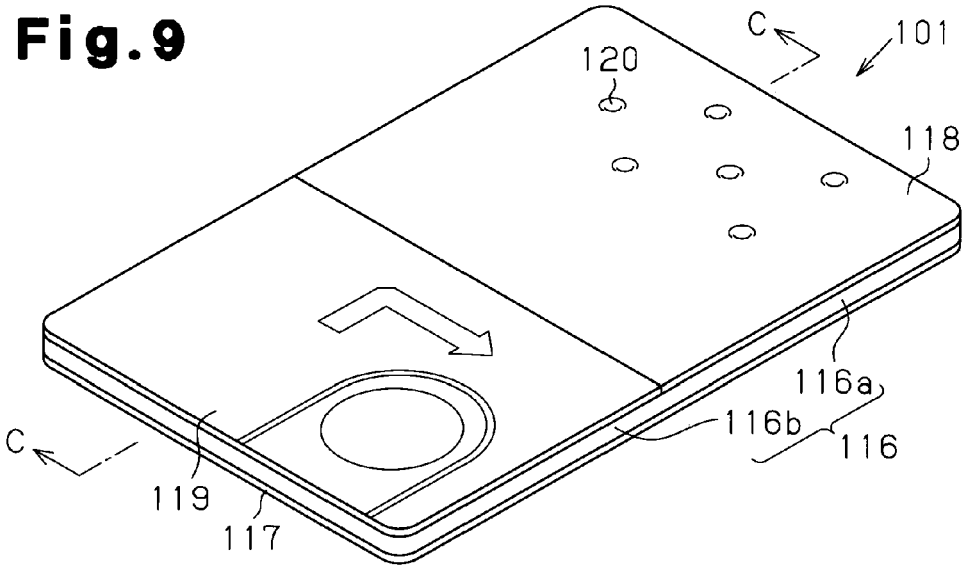
FIG. 9 is a perspective view showing a card key in which a concealment sticker is partially depressed.
Figure 10:
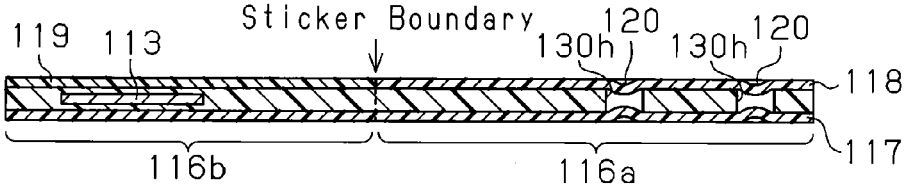
FIG. 10 is a cross-sectional view taken along line C-C in FIG. 9.

(1) The fitting members 30*u* are fitted to the through holes 30*h*. Thus, the depressions 120 formed in the concealment sticker of the example shown in FIGS. 9 and 10 are not formed in the first concealment sticker 18. This prevents the layout pattern of the through holes 30*h* from being wrongfully discerned prior to removal of the first concealment sticker 18.

(2) When removing the first concealment sticker 18, which is adhered to the first card portion 16*a* and the fitting members 30*u*, the fastening force produced by the adhesive agent between the first concealment sticker 18 and the fitting members 30*u* separates the fitting members 30*u* from the through holes 30*h*. The fitting members 30*u* are fastened to the first concealment sticker 18 after the first concealment sticker 18 is removed from the first card portion 16*a*. Thus, the first card portion 16*a* may be used as soon as the first concealment sticker 18 is removed since there is no need to separate the fitting members 30*u* from the first card portion 16*a*.

Further, manual separation of the fitting members 30*u* from the first card portion 16*a* would be burdensome. In addition, some fitting members 30*u* may be left without being separated from the first card portion 16*a*. However, in the present embodiment, the fitting members 30*u* are all adhered to the first concealment sticker 18 and simultaneously separated from the first card portion 16*a*. Thus, the possibility of some of the fitting members 30*u* remaining in the through holes 30*h* is lowered. This avoids a state in which mechanical ID verification cannot be performed due to some of the fitting members 30*u* remaining in the through holes 30*h*. The first card portion 16*a* is used as a locking and unlocking means when electronic verification cannot be performed with the communication control circuit due to reasons such as battery drainage. Thus, the first card portion 16*a* is desirable since it easily becomes usable and is thereby convenient to the user. Additionally, the fitting members 30*u* that become unnecessary are not scattered since the adhesive agent of the first concealment sticker 18 keeps the fitting members 30*u* fastened to the first concealment sticker 18. Therefore, the fitting members 30*u* can easily be disposed of together with the first concealment sticker 18.

Figure 6:
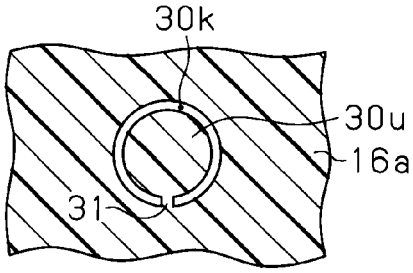
FIG. 6 is a cross-sectional view taken along line B-B in FIG. 4 and showing a state in which the wall surface of a through hole is partially connected to a fitting member.

A second embodiment according to the present invention will now be discussed with reference to FIG. 6. The discussion will center on differences from the first embodiment. As shown in FIG. 5, in the first embodiment, each fitting member 30*u* is a discrete component completely separated from the corresponding through hole 30*h*. In the second embodiment, each fitting member 30*u* is not completely separated from the corresponding through hole 30*h*. More specifically, in the example of FIG. 6, a brittle member 31 connects part of the peripheral surface of each fitting member 30*u* to the wall surface of the corresponding through hole 30*h*. To form the brittle members 31 that connect the through holes 30*h* and fitting members 30*u*, for example, a laser beam is emitted against a blank first card portion 16*a* in a direction orthogonal to the plane of the first card portion 16*a*. The laser beam is moved along the contour of a through hole 30*h*. The gradually forms the wall surface of the through hole 30*h*. At the same time, a corresponding cylindrical fitting member 30*u* is gradually formed. The emission or movement of the laser beam is stopped before the track of the laser beam forms a complete circuit, that is, in a state in which the fitting member 30*u* and through hole 30*h* are partially connected to each other. This leaves the brittle member 31 formed between the fitting member 30*u* and through hole 30*h*. Instead of forming the brittle member 31 with a laser beam, machining may be performed to form the brittle member 31.

The mechanical strength of the brittle member 31 is set so that the brittle members 31 break when external force of a predetermined level is applied. The mechanical strength of the brittle members 31 may be adjusted by the width, thickness, and the like of the brittle members 31, which are left on the first card portion 16*a* when formed. For example, the mechanical strength of the brittle members 31 is set so that the brittle members 31 are broken by a force that is weaker than the adhesiveness, or adhesive force, of the adhesive agent applied to the rear surface of the first concealment sticker 18. As a result, when removing the first concealment sticker 18 from the first card portion 16*a*, the fitting members 30*u* are separated from the through holes 30*h* and are then held in a state fastened to the first concealment sticker 18 in the same manner as in the first embodiment.

In addition to advantages (1) and (2) of the first embodiment, the second embodiment has the advantage described below.

(3) When external force of the predetermined level or greater is applied to the brittle members 31 arranged between the corresponding through holes 30*h* and fitting members 30*u*, the brittle members 31 break and the fitting members 30*u* are separated from the through holes 30*h*. Thus, after forming the through holes 30*h*, the first concealment sticker 18 may be adhered to the first card portion 16*a* without the need for fitting the fitting members 30*u* to the through holes 30*h*. Further, the through holes 30*h* and the fitting members 30*u* are partially connected together. This prevents the fitting members 30*u* from falling out of the through holes 30*h* in an unexpected manner.

It should be apparent to those skilled in the art that the present invention may be embodied in many other specific forms without departing from the spirit or scope of the invention. Particularly, it should be understood that the present invention may be embodied in the following forms.

Figure 7:
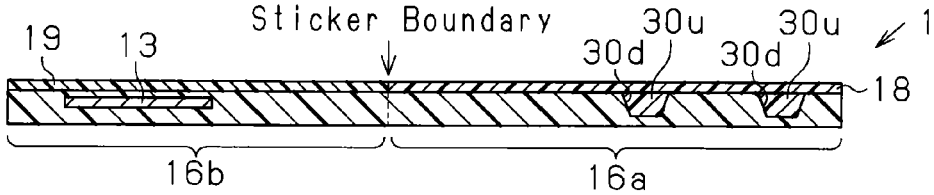
FIG. 7 is a cross-sectional view taken along line A-A in a state in which the through holes of FIG. 2 are replaced by dimples.

In each of the above-described embodiments, the through holes 30*h* may be replaced by dimples 30*d*, which are depressions as shown in FIG. 7. Such a structure eliminates the projections and recesses of the verification code from the surface that is opposite the surface of the dimples 30*d*. This eliminates the need for adhering a concealment seal to both opposite surfaces of the card key. Therefore, the thickness of the card key may be further reduced. Further, the employment of the dimples 30*d* enables the depths of the dimples 30*d* to be used as part of the verification code. Thus more key patterns may be formed in comparison with when employing the trough holes 30*h*. The positions, quantity, and sizes of the through holes 30*h* or dimples 30*d*, the depths of the dimples 30*d*, and a combination of these factors obtains many types of mechanical code patterns. Since there are many types of verification codes, card keys of different verification codes may be produced in mass amounts.

In each of the above-described embodiments, the fitting members 30*u* are fitted to all of the through holes 30*h*. However, the fitting members 30*u* may be fitted to only some of the through holes 30*h*.

Figure 8:
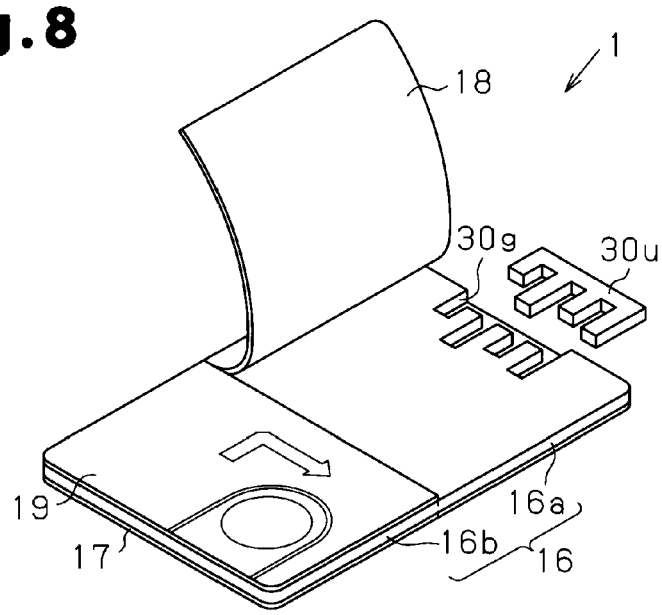
FIG. 8 is a perspective view showing a card key according to a further example of the present invention.

In each of the above-described embodiments, the through holes functioning as the verification code extend in a direction orthogonal to the plane of the main card body 16. Instead, a cutaway portion 30*g* having a recess-projection pattern may be formed in a periphery or an edge portion of the main card body 16 as shown in FIG. 8. In this case, in a state in which the fitting member 30*u* is fitted to the cutaway portion 30*g*, the fitting member 30*u* has front and rear surfaces that are both flush with the front and rear surfaces of the first card portion 16*a*. In this state, the first concealment sticker 18 is adhered to the front surface of the first card portion 16*a*, which includes the fitting member 30*u*.

In each of the above-described embodiments, the communication circuit 13 is used to perform electronic verification. However, the communication circuit 13 may be eliminated. This would further reduce the size and weight of the card key 1. In this case, the card key 1 is used as just a mechanical key.

In each of the above-described embodiments, when removing the first concealment sticker 18, the fitting members 30*u* fasten to the adhesive surface of the first concealment sticker 18 and thus do not have to be manually separated from the through holes 30*h*. However, after removal of the first concealment sticker 18, the fitting members 30*u* may be separated from the through holes 30*h*. In this case, the adhesiveness of the adhesive agent for the first concealment sticker 18 is set so that the fitting members 30*u* do not fasten to the first concealment sticker 18 when removing the first concealment sticker 18.

In each of the above-described embodiments, the card key 1 is used as a vehicle key. However, the card key 1 may be used for other purposes, for example, as a key for a building such as a house.

In the second embodiment, the brittle members 31 are formed from the same material as the first card portion 16*a* and the fitting members 30*u*. However, the brittle members 31 may be formed from a material that differs from the material of the first card portion 16*a* and the fitting members 30*u*.

The present examples and embodiments are to be considered as illustrative and not restrictive, and the invention is not to be limited to the details given herein, but may be modified within the scope and equivalence of the appended claims.

What is claimed is:

1. A card type mechanical key comprising:

a card member having a card surface, an edge portion, and a mechanical code pattern functioning as a verification code mechanically verifiable by a lock device, the mechanical code pattern being formed by partially eliminating the card surface or the edge portion;

a fitting member fitted to the mechanical code pattern; and a concealment sticker adhered removably to the card member in a state in which the fitting member is fitted to the mechanical code pattern of the card member so as to conceal the mechanical code pattern and the fitting member;

wherein:

the concealment sticker includes an adhesive surface to which an adhesive agent is applied, with the adhesive surface being adhered to the card member;

the fitting member is retained on the concealment sticker by the adhesive agent of the concealment sticker; and when removing the concealment sticker from the card member, the fitting member is separated from the mechanical code pattern together with the concealment sticker in a state adhered to the adhesive surface of the concealment sticker.

2. The card type mechanical key according to claim 1, further comprising:

a brittle member which partially connects the mechanical code pattern of the card member and the fitting member;

wherein the brittle member, the fitting member, and the card member are formed integrally, and the brittle member breaks when subjected to an external force separating the fitting member from the mechanical code pattern during use of the mechanical key.

3. The card type mechanical key according to claim 1, further comprising:

a communication circuit which performs electronic verification through wireless communication with a controller that electrically opens and closes the lock device.

4. The card key according to claim 1, wherein:

the mechanical code pattern is formed by through holes or dimples laid out on the card surface of the card member;

the fitting member is shaped in correspondence with the diameter of each of the through holes or dimples; and the fitting member is fitted to each of the through holes or the dimples.

5. A card type mechanical key comprising:

a card member having a card surface, an edge portion, and a mechanical code pattern functioning as a verification code mechanically verifiable by a lock device, the mechanical code pattern being formed by partially eliminating the card surface or the edge portion;

a fitting member fitted to the mechanical code pattern; and a concealment sticker adhered removably to the card member in a state in which the fitting member is fitted to the mechanical code pattern of the card member so as to conceal the mechanical code pattern and the fitting member;

wherein the adhesive agent of the concealment sticker has an adhesiveness that is set so that once the concealment sticker is removed from the fitting member and the card member, the concealment sticker cannot be adhered again to the fitting member and the card member.

6. The card key according to claim 1, wherein the fitting member has an end surface that is flush with the card surface when fitted to the mechanical code pattern.

* * * * *